US005186091A

United States Patent [19]

Wolf

[11] Patent Number: 5,186,091

[45] Date of Patent: Feb. 16, 1993

[54] SHEETING SLITTER

[76] Inventor: Michael Wolf, Bay #929 Barnett Dr., Lake Worth, Fla. 33461

[21] Appl. No.: 695,725

[22] Filed: May 6, 1991

[51] Int. Cl.[5] ..... B26D 1/03; B65H 35/02

[52] U.S. Cl. ..... 83/649; 83/858; 30/338

[58] Field of Search ..... 83/649, 856, 858, 425.2; 30/294, 298.2, 298.4, 334, 290, 338

[56] References Cited

U.S. PATENT DOCUMENTS

| | | | |
|---|---|---|---|
| 2,007,491 | 7/1935 | Anderson | 30/290 |
| 3,971,279 | 7/1976 | Wright | 83/425.2 |
| 4,503,612 | 3/1985 | Davis | 30/294 |
| 5,025,692 | 6/1991 | Reynolds | 83/649 |

*Primary Examiner*—Hien H. Phan
*Attorney, Agent, or Firm*—Victor F. Volk

[57] ABSTRACT

A plurality of slitting devices for rolls of sheeting can be clipped onto a dispensing carton so that the sheeting is readily slit to width as it is drawn from the carton. The devices are folded from single flat steel units so as to guard the edges of blades securely when not in use.

7 Claims, 1 Drawing Sheet

SHEETING SLITTER

BACKGROUND OF THE INVENTION

Flexible sheeting material of different types must be slit to the required width at the site and time of installation. Such sheeting, as, for example, the glare resistant film that is applied to the windows of buildings and vehicles, is packaged in rolls of great length in elongated portable cardboard boxes. Strips of the proper dimensions for particular window panes must be cut from these rolls, and such cutting can be an awkward job due to the conditions at the work site, which are beyond the operator's control, and the flimsiness and static adhesiveness of the film.

Commercially available single-edge razor blades, as blades which have one edge finely sharpened and the opposite edge protected by a folded and crimped metal strip are called, have been long used to slit sheetings, including film sheetings but my present improvement in devices for protectively holding the blade has the novel advantages of keeping the sharp edges of the blade completely protected when the blade is not in use while easily exposing an end of the blade for cutting, allowing different portions of the cutting edge to contact the film as the edge becomes dull, including reversal of the blade in the device, and means for clamping the device onto a standard corrugated-board box to cut film sheeting as it is withdrawn. But my device is also very useful for cutting sheeting by hand and can be safely held so as to lock the blade firmly during use. The same means that clamp my device to a dispensing container will clip it to an operator's clothing for safe keeping.

SUMMARY OF THE INVENTION

I have invented a device for gripping a cutting blade, such, preferably, as a single-edge razor blade. This device comprises a unit of rigid sheet material, such, preferably, as steel, of uniform thickness. The unit has a principal rectangular portion, two narrow extensions projecting from the rectangular portion at spaced-apart end areas thereof, walls that define an open rectangular relief in the center of the center of the rectangular portion at an edge that is opposite the extensions and bends in the extension that fold them substantially parallel to the principal portion. There are also two bends that fold areas of the rectangular portion that are contiguous to said extensions to be at right angles to the center of the principal portion. A substantially 180 deg. bend at the center of the rectangular portion folds areas of that portion so as to grip the blade.

In some improved embodiments my device comprises displacements in a section of the sheet in line with the relief-defining walls so as to from a channel between the folded portions to contain the protected edge of a razor blade.

My invention may comprise a combined dispenser and slitter for a roll of sheeting, comprising a container with a vertical wall and at least one of my devices clamped on an upper edge of said wall. The devices clamped to the container wall comprise blades, such, preferably, as single-edge razor blades with their sharp edges projecting upwardly so that the sheeting will be slit when it is pulled over the upper edge of the container wall.

DETAILED DESCRIPTION OF PREFERRED EMBODIMENT

Figure 1:
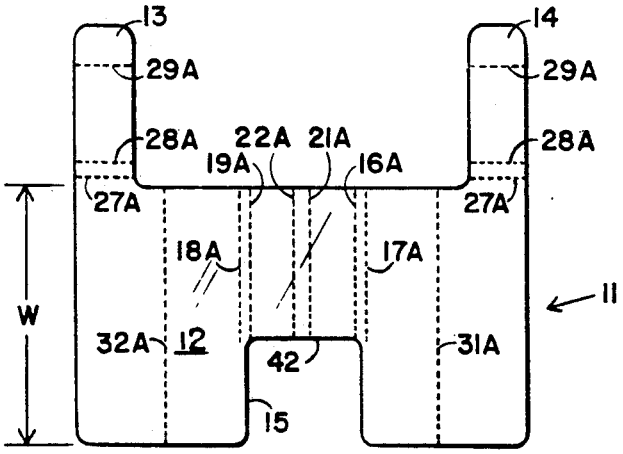
FIG. 1 is a plan of the unit from which my device is folded.
Figure 4:
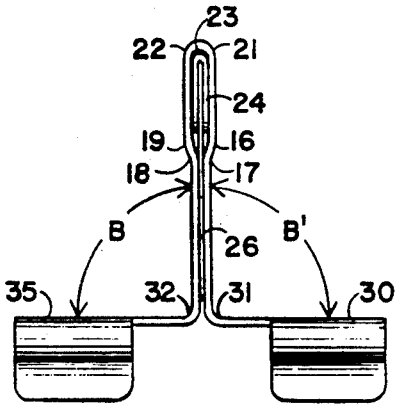
FIG. 4 is a top view of the device of FIG. 2.
Figure 2:
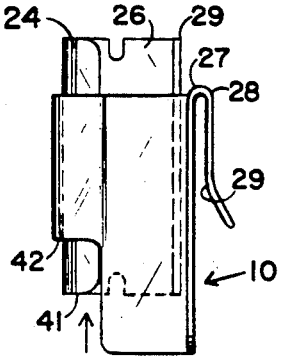
FIG. 2 is a side elevation of a device of my invention.
Figure 3:
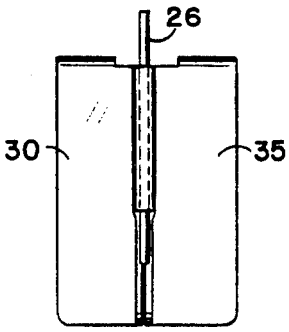
FIG. 3 is a front view of the device of FIG. 2.
Figure 5:
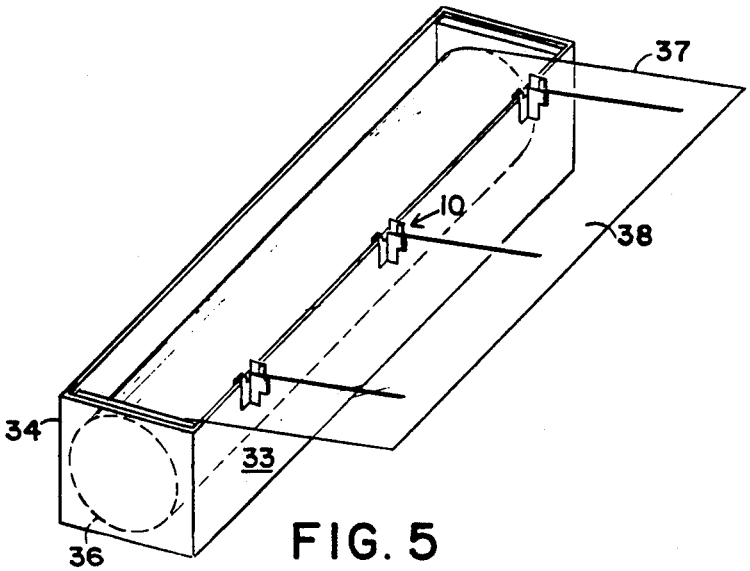
FIG. 5 is a pictorial view of my combined slitter and dispenser.

Referring first to FIG. 2 my device 10 has been formed inexpensively by bending the blank 11 of FIG. 1 which is a unit of sheet steel about 0.034 inches (0.86 mm) thick. The blank 11 has a principal rectangular portion 12 with a width "w" of about 1.6 inches (4 cm). Extensions 13, 14 project from the portion 12 and opposite these projections a relief 15 has been stamped out of the blank 11. Displacements 16, 17 (FIG. 4) have been made in the section of the blank along the respective lines 16A, 17A and displacements 18, 19, have been made along the respective lines 18A, 19A, and the blank has been folded at 21, 22 along the respective lines 21A, 22A to form a channel 23 for a crimped strip 24 on the unsharpened edge of a razor blade 26. The extensions 13, 14 are folded parallel to the portion 12 at bends 27, 28 along respective lines 27A 28A and are folded outward at a bend 29 along a line 29A. Bends 31, 32 are made in the principal portion 12 at angles, B, B', that are very slightly smaller than right angles, along lines 31A, 32A of FIG. 1. These bends form the flanges 30, 35 (FIG. 3). After being bent the extensions 13, 14 form clips that can fasten one or more of my devices 10 to a wall 33 of a corrugated box 34 holding a roll 36 of film sheeting 37 to be longitudinally slit as it is pulled from the box 34. The sheeting 37 is a known commercial product used to glare-proof windows, and a leading crosswise portion 38 of the sheeting has been left imperforate so that the whole width can be manually pulled as a unit although the following length is slit into a plurality of strips.

A sharp edge 39 of the blade 26 is exposed by pressing upwardly against an exposed end section 41 (FIG. 2) and this sharp edge faces inwardly of the box 34 when the devices 10 are clipped to the wall 33. The blades need initially only be exposed sufficiently to prevent the sheeting from popping off of them but, when this exposed portion has been dulled the blades can be further exposed, in steps, until the end section 41 reaches a ledge 42 formed in the original relief 15. The blades can then be reversed end-to-end in their devices 10 to get the maximum use of their cutting edges. When a blade is initially introduced into the device 10 it has a slide fit that will hold it against gravity but, if the clips formed of the extensions 13, 14 are pressed toward each other, even slightly, the grip on the blade becomes very firm. This effect occurs when the devices are clipped onto the wall 33 due to the fact that the flanges are thereby urged to form a straight line.

With the blade completely covered my device 10 can be safely clipped to a pocket or belt and it can be safely used for cutting fabrics, carpets, or other articles by hand because of its above-described pressure grip with the advantage that no insertion or tightening of screws or removal of safety covers is required.

The foregoing description has been exemplary rather than definitive of my invention for which I desire an award of Letters Patent as defined in the appended claims.

I claim:

1. A combined dispenser and slitter for a roll of sheeting comprising:

(I) a device for gripping a cutting blade, said device being formed from a unit of rigid sheet material of uniform thickness comprising:

(a) a principal rectangular portion thereof, (b) two narrow extensions projecting from said principal rectangular portion at spaced-apart end areas thereof, (c) walls defining an open rectangular relief in the center of said rectangular portion at an edge thereof opposite said extensions, and said device comprising (d) bends in said narrow extensions, folding said narrow extensions substantially parallel to contiguous lengths of said principal rectangular portion, (e) two bends in said principal rectangular portions, said bends folding areas of said principal rectangular portion and said extensions so as to extend at approximate right angles to contiguous area of the center of said principal rectangular portion, at least one of said right angles being very slightly less than 90 deg. whereby aligning said extensions will tighten the grip of said device upon a blade, and (f) a substantially 180 deg. bend midway of said principal rectangular portion folding areas of said principal rectangular portion so as to grip said blade, (II) a container comprising a substantially vertical wall having an upper edge, said device being clamped on said upper edge of said wall, and (III) a blade comprising a sharp edge projecting upwardly from said device.

2. The combined dispenser and slitter of claim 1 wherein said blade comprises a single-edge razor blade.

3. The combined dispenser and slitter of claim 1 comprising like pluralities of said devices and said blades, wherein said sheeting comprises a continuous leading edge, said blades first penetrating said sheeting upstream of said leading edge.

4. A device for gripping a cutting blade, said device being formed from a unit of rigid sheet material of uniform thickness comprising, (a) a principal rectangular portion thereof, (b) two narrow extensions projecting from said principal rectangular portion at spaced-apart end areas thereof, (c) walls defining an open rectangular relief in the center of said rectangular portion at an edge thereof opposite said extensions, and said device comprising (d) bends in said narrow extensions, folding said narrow extensions substantially parallel to contiguous lengths of said principal rectangular portion, (e) two bends in said principal rectangular portions, said bends folding areas of said principal rectangular portion and said extensions so as to extend at approximate right angles to contiguous area of the center of said principal rectangular portion, at least one of said right angles being very slightly less than 90 deg. whereby aligning said extensions will tighten the grip of said device upon a blade, and (f) a substantially 180 deg. bend midway of said principal rectangular portion folding areas of said principal rectangular portion so as to grip said blade.

5. The device of claim 4 wherein said material comprises steel.

6. The device of claim 4 comprising displacements in said principal rectangular portion in line with said relief-defining walls thereby forming a channel between said folded areas of said portion for containing the protected edge of a razor blade.

7. The device of claim 4 wherein said rectangular portion is approximately 1.6 inches (4.06 cm) wide.

* * * * *